US005341194A

United States Patent [19]

Haneda et al.

[11] Patent Number: 5,341,194

[45] Date of Patent: Aug. 23, 1994

[54] BELT TYPE IMAGE FORMING UNIT

[75] Inventors: Satoshi Haneda; Shizuo Morita; Masakazu Fukuchi; Shunji Matsuo, all of Hachioji, Japan

[73] Assignee: Konica Corporation, Tokyo, Japan

[21] Appl. No.: 869,894

[22] Filed: Apr. 15, 1992

Related U.S. Application Data

[62] Division of Ser. No. 610,382, Nov. 5, 1990, abandoned.

[30] Foreign Application Priority Data

Nov. 7, 1989 [JP] Japan ..... 1-289596
Nov. 7, 1989 [JP] Japan ..... 1-289598
Nov. 21, 1989 [JP] Japan ..... 1-302813

[51] Int. Cl.[5] ..... G03G 21/00

[52] U.S. Cl. ..... 355/212; 355/208; 355/215; 355/221; 355/282

[58] Field of Search ..... 355/212, 296, 299, 301, 355/326, 245, 300, 211, 282, 200, 285-295, 210, 219, 221, 215, 298

[56] References Cited

U.S. PATENT DOCUMENTS 4,271,786 6/1981 Buckley et al. ..... 355/245 X
4,596,457 6/1986 Peeters et al. ..... 355/212 X
4,640,608 2/1987 Higaya et al. ..... 355/299
4,796,057 1/1989 Howard et al. ..... 355/299
4,841,333 6/1989 Damji ..... 355/211
4,956,676 9/1990 Fukae et al. ..... 355/326 X

FOREIGN PATENT DOCUMENTS 57-120970 7/1982 Japan .
60-83071 5/1985 Japan ..... 355/212
61-133956 7/1986 Japan ..... 355/212
62-50872 3/1987 Japan ..... 355/212
62-124570 6/1987 Japan ..... 355/212

OTHER PUBLICATIONS

Patent Abstracts of Japan, vol. 10 No. 243 (p. 489) (2299); Aug. 21, 1986 JPA-61-73,178; Apr. 15, 1986.
Patent Abstracts of Japan, vol. 10 No. 288 (p. 502) (2344); Sep. 30, 1986 JPA-61-107,281; May 26, 1986.
Patent Abstracts of Japan, vol. 12 No. 240 (p. 727) (3087); Jul. 8, 1988 JPA-63-32,583; Feb. 12, 1988.

*Primary Examiner*—A. T. Grimley
*Assistant Examiner*—Shuk Y. Lee
*Attorney, Agent, or Firm*—Jordan B. Bierman

[57] ABSTRACT

The invention provides a photoreceptor belt for forming a latent image on its imaging surface. The photoreceptor belt is stretched in the form of a loop around a plurality of rollers so as to be rotated for carrying a formed image. Both ends of the photoreceptor belt are bonded in the manner that the leading end in relation to the rotation direction is positioned inside than the trailing end in relation to the form of loop and the inner surface of the trailing end is superimposed on the outer surface of the leading end. Cleaning device for cleaning the imaging surface of the photoreceptor belt is disposed to have a cleaning direction opposite to the rotation direction of the photoreceptor belt. The photoreceptor belt is positioned to stop where the bonded ends of the belt are proximate to the corona charging device. The photoreceptor belt is then positioned to stop where the bonded ends of the belt are proximate to the fixing device when the next image formation is not conducted within a period of time after the previous image formation.

2 Claims, 7 Drawing Sheets

BELT TYPE IMAGE FORMING UNIT

This application is a division, of application Ser. No. 07/610,382, filed Nov. 5, 1990, now abandoned.

BACKGROUND OF THE INVENTION

This invention relates to a color image forming device for forming toner images on a belt type image forming unit by the electrophotographic method and transferring them on a transfer material to form images.

Various methods and devices for forming color images by the electrophotographic method have been proposed. As indicated in Japanese Patent Publication-Open to Public Inspection No. 100770 (1986), for example, there is a method that latent images are formed and developed on a photosensitive drum which is an image forming unit according to the number of separated colors of an original image, and the developed images are transferred onto a transfer drum at each development to form a multi-color image on the transfer drum, and then the multi-color image is transferred onto a recording paper to obtain a color copy. A device using this method requires a transfer drum having a peripheral surface which is large enough for one image to be transferred on besides the photosensitive drum. Therefore, such a device is inevitably large in size and complicated.

As indicated in Japanese Patent Publication-Open to Publication Inspection No. 149972 (1986), for example, there is another method that latent images are formed and developed on a photosensitive drum according to the number of separated colors of an original image, and the developed images are transferred onto a transfer material at each development to form a multi-color copy. By this method, it is difficult to accurately superimpose multi-color images and good quality color copies cannot be obtained. There is another method available that the forming of latent images on a photosensitive drum according to the number of separated colors of an original image and the development of images by color toners are repeated, and the color toner images are superimposed on the photosensitive drum and transferred onto a transfer material to obtain a color image. The basic process of this multi-color image forming is indicated in Japanese patent Publication-Open to Publication Inspection No. 75850 (1985), 76766 (1985), 95456 (1985), 95458 (1985), and 158475 (1985) by the applicant of this patent.

In a multi-color image forming device for obtaining color images by superimposition, a plurality of developing units containing different colors from each other are installed around the photosensitive drum and latent images on the photosensitive drum are developed by rotating the photosensitive drum several times to obtain a color image.

As to an image forming unit, as described above, a photosensitive drum which is coated or deposited with a photoconductor on the peripheral surface thereof and a belt type image forming unit with a flexible belt coated or deposited with a photoconductor have been proposed. Since the belt type image forming unit (hereinafter may be called the photosensitive belt) is formed in a shape by stretching between rotating rollers including drive roller, it is effective for a color image forming device which is made compact for effective space use. Since the photosensitive belt can move along a small curvature, a transfer material can be separated at the curvature by using a rotating roller with a small diameter to prevent poor separation of the transfer material.

Since the belt type image forming unit mentioned above is a photosensitive thin sheet with a conductive layer inserted between the base and an organic photosensitive layer and used in an endless form, it can be manufactured as follows: A cylindrical photoconductor is formed by casting, and cut into pieces with a necessary width to produce belt type photoconductor. However, there is a problem imposed by this method. Since the thickness of each photoconductor is extremely thin such as 0.1 mm and the thickness should be accurate, the forming is technically hard and it is rather difficult to obtain a belt type image forming unit of satisfactory quality.

A method that both ends of a photoconductor sheet produced using a film (extruded and elongated thin film) of polyethylene terephthalate or others are spliced to form an endless photoconductor belt has also been tried. However, the difference in level caused by splicing both ends cannot be eliminated, no image can be formed on the spliced part, the photoconductor may slip by touching of the cleaning member, or the spliced part may be separated in an extreme case, causing problems in the durability. The first object of the present invention is to solve the above problem and to provide a color image forming device which can be used for a long period of time with a good conveyability and durability not being affected by an elastic cleaning member which acts on a belt type image forming unit which is formed by bonding.

Since the difference in level which is equivalent to the photoconductor thickness occurs at the spliced part, an unnecessary amount of toner of the developer is adhered to the step even in the non-contact development. In the case of color images, therefore, a color toner may be mixed into another color developing unit, and when a carrier is adhered, the photoconductor may be damaged during cleaning. The second object of the present invention is to solve the above problem and to provide an image forming device which can produce images of high quality without the adhierence of unnecessary toner or carrier even when a photosensitive belt having spliced part is used.

SUMMARY OF THE INVENTION

The first object of the present invention is accomplished by a color image forming device which superimposes toner images on a belt type image forming unit having a spliced part which is stretched between a plurality of moving rollers, characterized in that the spliced part of the belt type image forming unit is constructed so that the end of the image forming unit in the movement direction comes in under the other end, and a cleaning means has a contact and release facility, and the cleaning direction of the cleaning means is opposite to the movement direction of the belt type image forming unit.

The second object of the present invention is accomplished by an image forming device which has a developing unit for performing non-contact development installed on the periphery of a belt type image forming unit with the spliced part which is stretched between a plurality of moving rollers, characterized in that the gap (D) between the developer layer of the developing unit and the belt type image forming unit is larger than the belt thickness (t) of the belt type image forming unit.

It is desirable that the image forming timing is controlled for the conveying cycle so that the spliced part of the belt type image forming unit is not included in the image region. It is also desirable at the time of stop that the stop timing is controlled so that the belt surface corresponding to the image forming part is stopped on a priority basis at a location where the surface can be protected physically or from the view point of the photosensitive characteristics, utilizing the spliced part which is not included in the image region. Another object of the present invention is to provide a color image forming device which can use the image forming part of the belt type image forming unit in the high quality state for a long period of time by specifying the stop position of the spliced part of the image forming means as mentioned above.

The above object of the present invention is accomplished by a color image forming device which superimposes toner images on a belt type image forming unit having the spliced part which is stretched between a plurality of moving rollers, characterized in that the stop position of the spliced part is one of the specified positions indicated below.

(i) Position close to the tension roller
(ii) Position close to the fixing unit
(iii) Position in or close to the cleaning unit
(iv) Position close to the corona charger

DETAILED DESCRIPTION OF THE PREFERRED EMBODIMENTS

Figure 1:
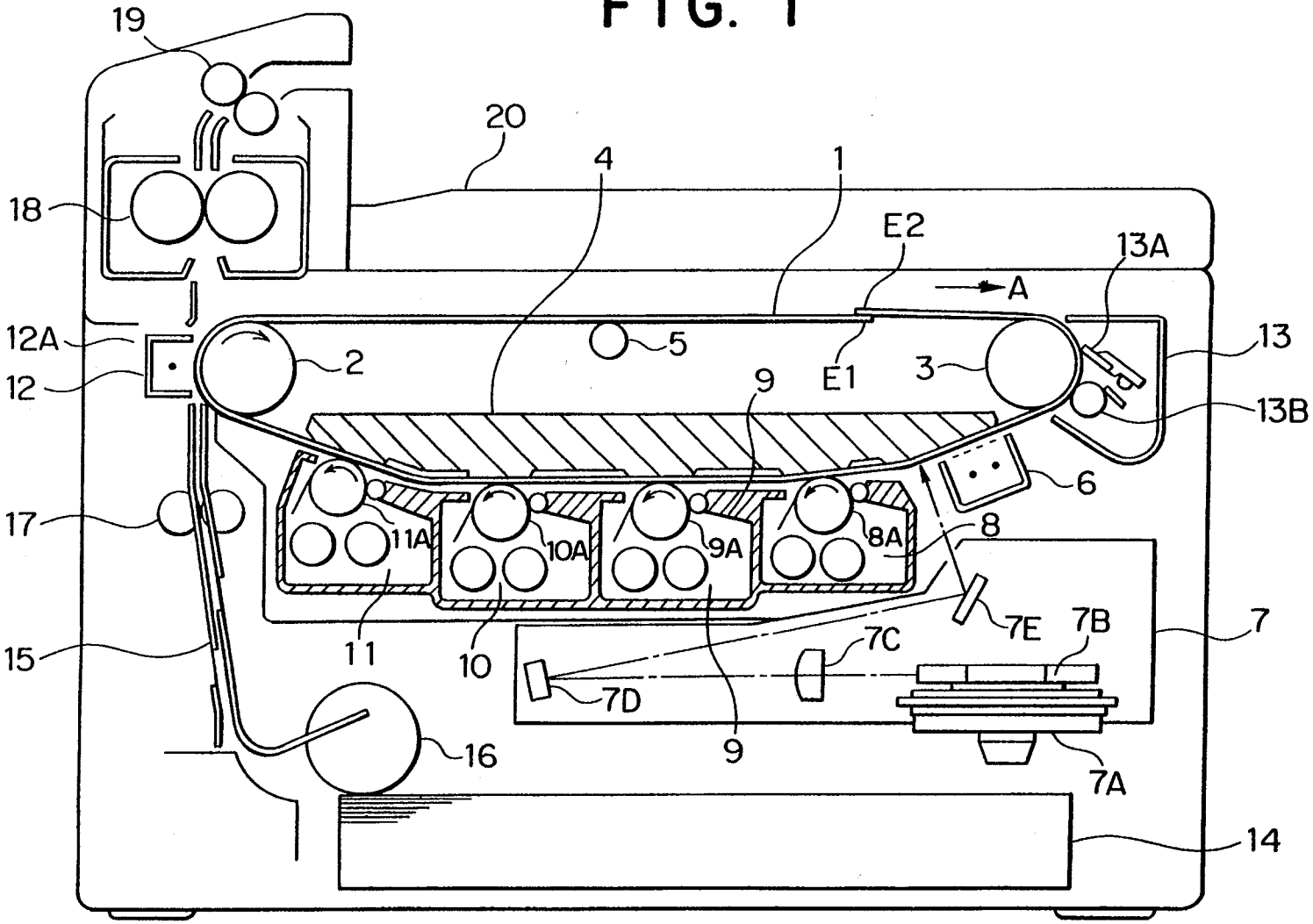
FIG. 1 is a sectional schematic view of a color image forming device of the present invention.
Figure 2:
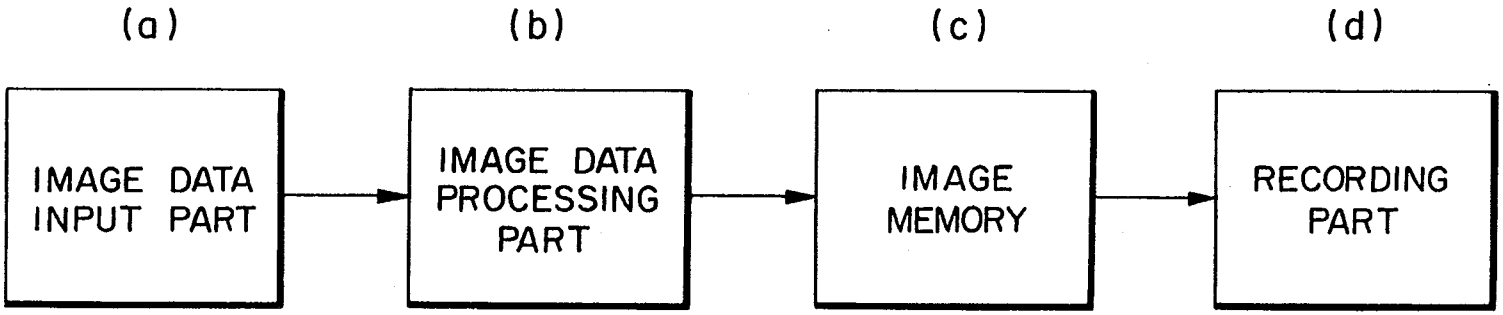
FIG. 2 is a block diagram showing an image forming system, FIGS. 3-A and 3-B are enlarged views of the essential section of a cleaning unit, FIGS. 4-A and 4-B are sectional views of the developing unit of the image forming device shown in FIG. 1.
Figure 3A:
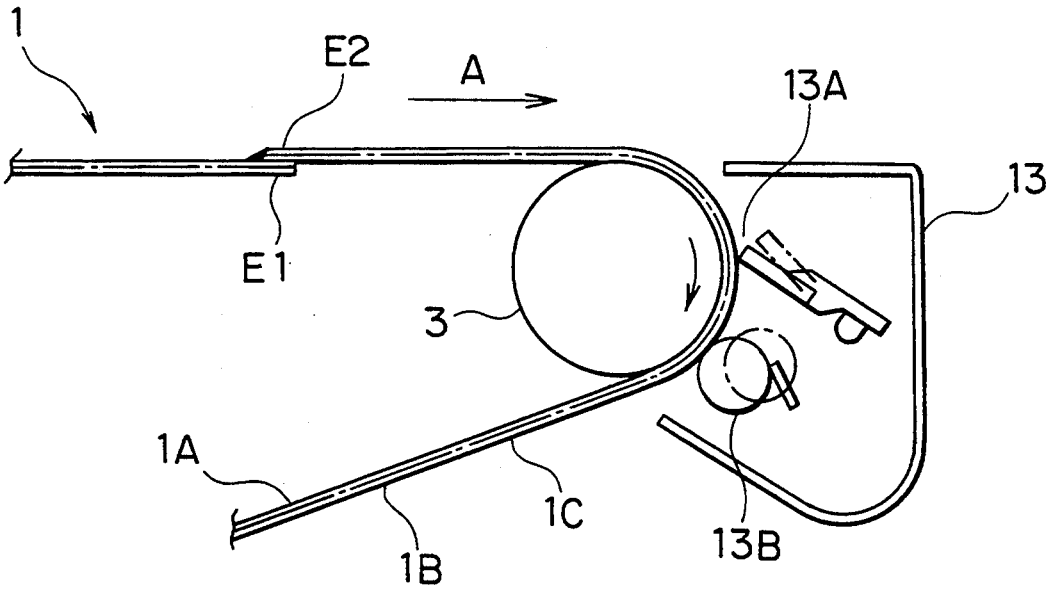
Figure 3B:
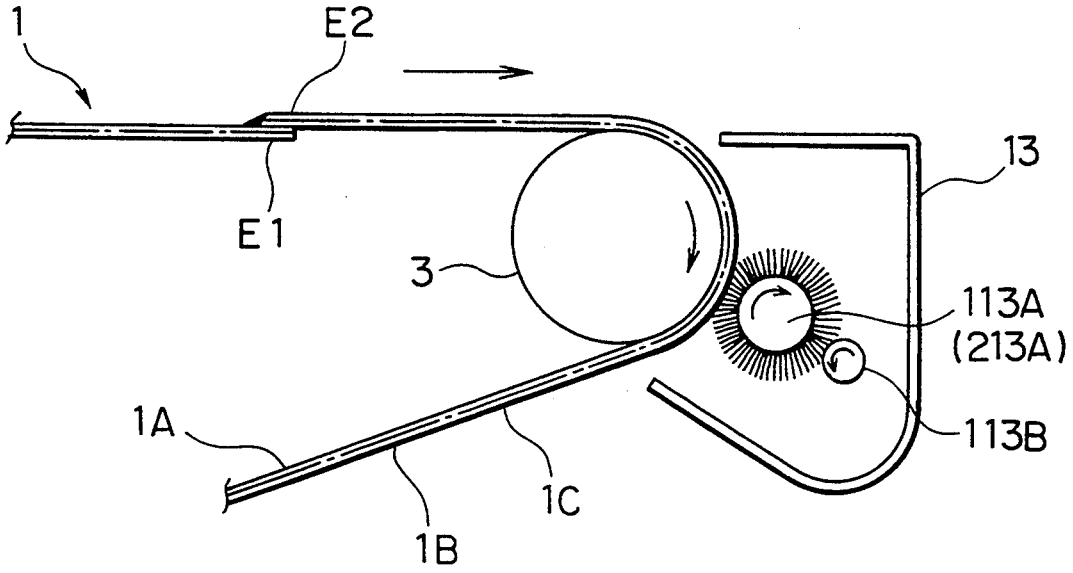

An embodiment of a color image forming device of the present invention is shown in FIGS. 1 to 3.

In FIG. 1, numeral 1 indicates a flexible photoconductor belt which is a belt type image forming unit, and the photoconductor belt 1 is stretched between a rotating roller 2 which is a rubber roller and a rotating roller 3 which is a metallic roller, and driven and conveyed clockwise by the rotating roller 2.

Numeral 4 indicates a guide member which inscribes the photoconductor belt 1, and the guide member 4 slides on the inner peripheral surface of the photoconductor belt 1 which is stretched by a tension roller 5 which is forced outward.

Therefore, the photoconductor on the outer peripheral surface of the photoconductor belt 1 is always kept at a fixed distance from the surface of the guide member 4 during conveying of the photoconductor belt to provide a stable image forming surface.

Numeral 6 indicates a scorotron charging unit which is a charging means, 7 a laser write system unit which is an image exposure means, and 8, 9, 10, and 11 developing units which are a plurality of developing means containing specifically colored developers respectively, and those image forming means are installed opposite to the guide member 4 of the photoconductor belt 1. To keep a gap against the photoconductor belt 1 so as to the movement of the photoconductor belt 1 is not interrupted, a gap holding means is provided to touch the guide member 4 at the outside of the photoconductor belt 1 in the width direction.

An optical system, in which an emission part and a convergent light transmitter are integrated, can be used instead of the optical system shown in the figure which is a laser write system unit 7.

The developing units 8, 9, 10, and 11 contain, for example, yellow, magenta, cyan, and black developers respectively, and are provided with developing sleeves 8A, 9A, 10A, and 11A, which are kept at a fixed distance from the photoconductor belt 1 and visualize the latent images on the photoconductor belt 1 by the non-contact developing method. The non-contact development is characterized in that, unlike the contact development, it does not interrupt the movement of the photoconductor belt.

Numeral 12 indicates a transfer unit, 12A a discharging bar, and 13 a cleaning unit comprising a blade 13A and a toner collection roller 13B which are kept away from the surface of the photoconductor belt 1 during image forming process and pressed against the surface of the photoconductor belt 1 as shown in the figure during cleaning process after image transfer.

The color image forming process of the color image forming device mentioned above will be described below.

In this embodiment, multi-color images are formed according to the image forming system shown in FIG. 2. Data obtained at a color image data input part ((a) in FIG. 2), where an image pick-up element scans an original image, is operated by an image data processing part ((b) in FIG. 2) to create image data, and the created image data is stored in an image memory ((c) in FIG. 2). The data of the image memory is read at the time of recording and supplied to a recording part ((d) in FIG. 2), for example, the color image forming device shown in the embodiment in FIG. 1.

When a color signal outputted from an image reader, which is different from the printer, is supplied to the laser write system unit 7, a laser beam generated by a semiconductor laser (not shown in the figure) of the laser write system unit 7 is rotationally scanned by a polygon mirror 7B which is rotated by a drive motor 7A, bent the path thereof by mirrors 7D and 7E via a f lens 7C, and irradiated onto the peripheral surface of the photoconductor belt 1, which is charged by the charging unit 6 beforehand, to form a bright line.

When the scanning starts, the beam is detected by an index sensor, the beam modulation by the 1st color signal starts, and the modulated beam scans on the peripheral surface of the photoconductor belt 1. As a result, a latent image corresponding to the 1st color is formed on the peripheral surface of the photoconductor belt 1 by the main scanning by the laser beam and the sub-scanning by conveying of the photoconductor belt 1. This latent image is reversely developed by the developing unit 8 containing a yellow (Y) toner (a developing medium) of the developing means in the non-contact state to form a toner image on the belt surface. The obtained toner image, which is retained on the belt surface, passes under the cleaning unit 13 where the cleaning means are away from the peripheral surface of the photoconductor belt 1 and goes to the next copy process.

The photoconductor belt 1 is charged by the charging unit 6 once again, the 2nd color signal outputted from the signal processing part is supplied to the write system unit 7, and data is written onto the drum surface in the same way as with the 1st color signal to form a latent image. The latent image is reversely developed by the developing unit 9 containing a magenta (M) toner as a 2nd color in the non-contact state.

This magenta (M) toner image is formed under the condition that the yellow (Y) toner image, which is already formed, exists.

Numeral 10 indicates a developing unit containing a cyan (C) toner, which forms a cyan (C) toner image on the belt surface according to a control signal generated by the signal processing part.

Numeral 11 indicates a developing unit containing a black toner, which superimposes a black toner image on the drum surface by the same processing. The sleeves of the developing units 8, 9, 10, and 11 are applied with a DC bias voltage or an AC bias voltage additionally, and jumping development is performed by a 1-component or 2-component developer of the developing means and reverse development is performed on the photoconductor belt 1, whose base is grounded, in the non-contact state.

The color toner image, which is formed on the peripheral surface of the photoconductor belt 1 in this way, is transferred onto a transfer material in the transfer part, which is conveyed from a paper feed cassette 14 via a paper feed guide 15.

The top sheet of the transfer material loaded in the paper feed cassette 14 is conveyed by the rotation of a paper feed roller 16 and sent to the transfer unit 12 and the discharging bar 12A via a timing roller 17 timely with the image forming on the photoconductor belt 1.

The transfer material, which is subject to image transfer and discharging, is surely separated from the photoconductor belt 1, which suddenly turns along the rotating roller 2, with the image quality not affected by scattered toners, and then moves up. After the image is melted and fixed by a fixing roller 18, the transfer material is ejected onto a tray 20 via paper ejection rollers 19.

The photoconductor belt 1, which finishes image transfer onto the transfer material, continues conveying. The cleaning unit 13 puts the blade 13A facing the rotating roller 3 and the toner collection roller 13B comprising a rotating sponge member into the contact state, removes residual toners, and separates the blade 13A once again and then the toner collection roller 13B after a while. The system goes to the next image forming process.

The photoconductor belt 1 is produced as follows: As shown in FIG. 3, a conductive layer 1B is laminated on a base 1A of polyethylene terephthalate (PET) 30 to 100 microns in thickness, and an OPC layer IC (10 to 30 microns in thickness) comprising a charge generation layer and a charge transfer layer is coated on the conductive layer (to form a photoconductor layer). The photoconductor sheet with a total thickness of about 0.1 mm is cut into a piece in a predetermined shape, and both ends thereof are spliced to form a endles belt. The endless belt is stretched against the rotating rollers 2 and 3 with the OPC layer IC facing outside, and circulated and conveyed endlessly in the direction of the arrow A.

The top end E1 of the belt in the movement direction of the photoconductor belt 1 or in the direction of the arrow A is overlaid with the back end E2 of the belt within an overlapping ange from 0.3 mm to 3 mm, and the both ends are spliced by the ultrasonic bonding method.

The edge of the back end E2 of the belt is chamfered obliquely, and the conductive layer 1B exposed on the chamfered part is sealed by a highly resistant sealing material.

When a method that both ends of a photoconductor sheet are spliced by the ultrasonic bonding method to form an endless photoconductor belt is used, a difference in level caused by splicing both ends cannot be eliminated, no image can be formed on the spliced part, the cleaning member may break or the photoconductor may slip by touching the cleaning member, or the spliced part may be separated in an extreme case, causing problems in the durability.

This is because the cleaning means acts in the direction opposite to the movement direction of the photoconductor. When the tip of the blade 13A is positioned counter to the movement direction of the photoconductor as shown in the figure, the back end of the belt should be bonded on the top end of the belt to prevent the tip of the blade from being caught in the step of the spliced part. Otherwise, the above problem is serious. When the tip of the blade 13A is positioned toward the downstream of the movement direction of the photoconductor, the above problem is not so serious, though cleaned toners are not easily ejected from the top surface of the blade, causing a reduction of cleanability.

Therefore, it is desirable that when using the blade 13A, the top end of the belt in the movement direction of the photoconductor is spliced under the back end of the belt and the tip of the blade 13A is positioned counter to the movement direction of the photoconductor.

Needless to say, when forming respective color toner images, the image forming timing for the conveying cycle of the photoconductor belt 1 is controlled so that the spliced part of the ends is not positioned within the picture plane.

The cleaning blade 13A and toner conveying roller 13B, which are cleaning means of the cleaning unit 13, are provided with a function for touching or releasing the contact from the photoconductor belt 1. When toner images are formed or superimposed, the blade and toner conveying roller are released from the contact; that is, separated from the peripheral surface of the photoconductor belt 1. Only when the blade and toner conveying roller are facing to the residual toner image on the photoconductor belt after toner image is transfered, they get into contact with the peripheral surface of the photoconductor, and are returned to the release state immediately as the image area passes.

The blade 13A is already released at the spliced part of the belt, and it is desirable that the toner collection roller 13B, which is in the contact state for removing the toners deposited on the blade 13A, is released after the spliced part of the belt passes.

Thus, the blade 13A has no chance to touch the spliced part of the photoconductor belt 1, and even if an elastic plate is used as a blade 13A, the blade 13A and the photoconductor belt 1 are not damaged and the conveyability is not lowered, providing an effective cleaning operation.

FIG. 3-B shows another embodiment, wherein a fur brush roller 113A with fibre planted on its surface or a cylinder having inner magnets which acts as a magnetic brush 213A attracting iron powder on its surface rotates as a cleaning means, slides the photoconductor belt 1 to clean by touching the brush. In this case, by rotating the fur brush 113A or the magnetic brush 213A in the counter direction to the movement direction of the photoconductor belt 1 as shown in the figure, no problems are caused in the spliced part of the photoconductor belt 1 during cleaning. Numeral 113B in the figure indicates a toner attraction roller which electrostatically attracts and removes cleaned toners by the fur brush 113A or the magnetic brush 213A.

The present invention using the above configuration provides a compact color image forming device which is characterized in that a belt type image forming unit of high quality can be realized by a simple manufacturing method, a powerful cleaning means can be used, and color images of high quality can be obtained at low cost.

Figure 4A:
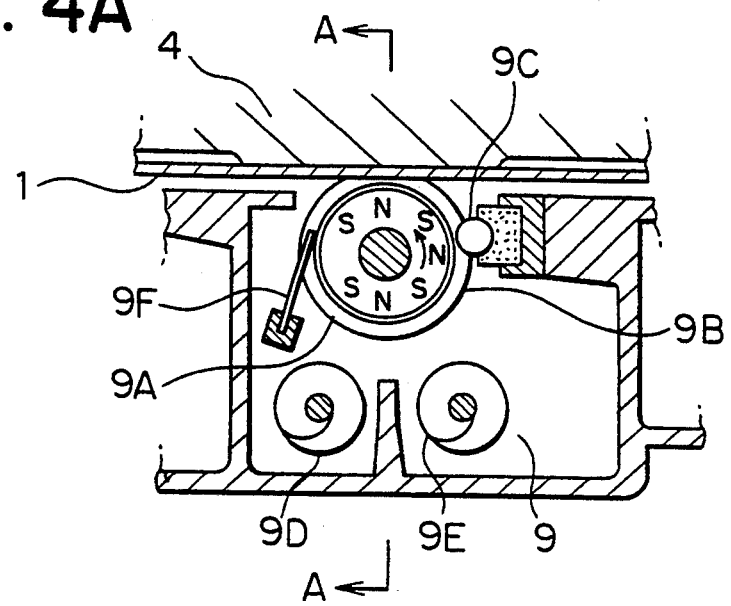
Figure 4B:
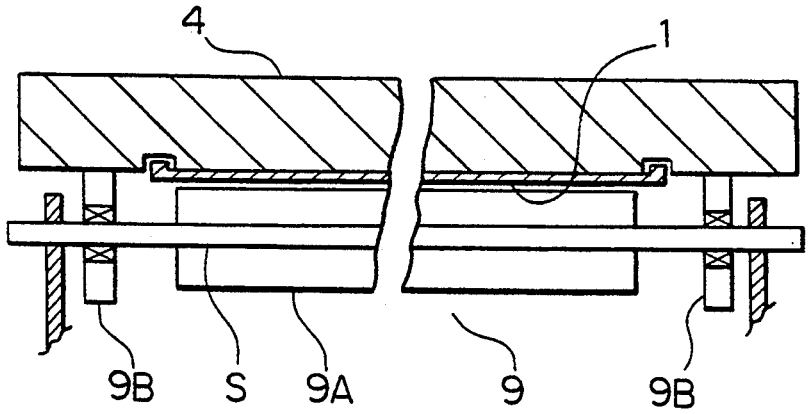

The structure of developing units, for example, which can be used in the present invention, is as follows: FIG. 4-A is a sectional view of the developing unit 9. Numeral 9A indicates a developing sleeve containing a fixed magnet roller, which is rotated counterclockwise with a predetermined developing gap kept against the peripheral surface of the photoconductor belt 1 by touching stopper rollers 9B mounted at both ends of the shaft thereof with the guide member 4. Numeral 9C indicates a thin layer forming member which is rigid and magnetic. The thin layer forming member 9C is pressed against the developing sleeve 9A at a predetermined load in the developer-free state. Numerals 9D and 9E indicate a pair of toner conveying screws for conveying and circulating a developer in the reverse directions each other, which stir and mix a toner and carrier thoroughly and send them to the developing sleeve 9A as a developer. The toner conveying screws 9D and 9E serve as stirring members which rotate in the reverse directions each other. The toner and carrier conveyed backward by the thrust of the toner conveying screw 9D are sent to the toner conveying screw 9E and conveyed forward by the thrust thereof. During that time, the toner and carrier are well mixed and charged by friction to produce a uniformly changed developer, which is adhered onto the peripheral surface of the developing sleeve 9A as a layer.

This developer layer adhered onto the peripheral surface of the developing sleeve 9A is made thin while it passes through the thin layer forming member 9C, and reversely develops a latent image on the peripheral surface of the photoconductor belt 1 to form a toner image, which is conveyed clockwise in the developing region, in the non-contact state with the developing gap kept.

During the non-contact development, a development bias voltage including a DC component and an additional AC component is applied to the developing sleeve 9A from a power source which is not shown in the figure. As a result, only the toner of the developer on the developing sleeve 9A is selectively transferred and adhered to the latent image.

The developer, wherein the toner is consumed and the carrier ratio increases, is conveyed by the developing sleeve 9A and scraped and collected by a scraper 9F, and then mixed with a developer with a high toner ratio.

FIG. 4-B is a sectional view of the arrow AA of the developing unit 9 shown in FIG. 4-A. In FIG. 4-B, numeral 9A indicates a developing sleeve of the developing unit 9 and 9B stopper rollers which are stopper members. A stopper roller is mounted to each end of the developing sleeve 9A and pivoted by a rotational shaft S so that it can be rotated freely.

The stopper rollers 9B are a little larger in outer diameter than the developing sleeve 9A so that when the stopper rollers are pressed against the guide member 4, a gap equivalent to the developing gap 0.2 to 1.0 mm can be formed between the peripheral surface of the developing sleeve 9A and that of the photoconductor belt 1.

Figure 5:
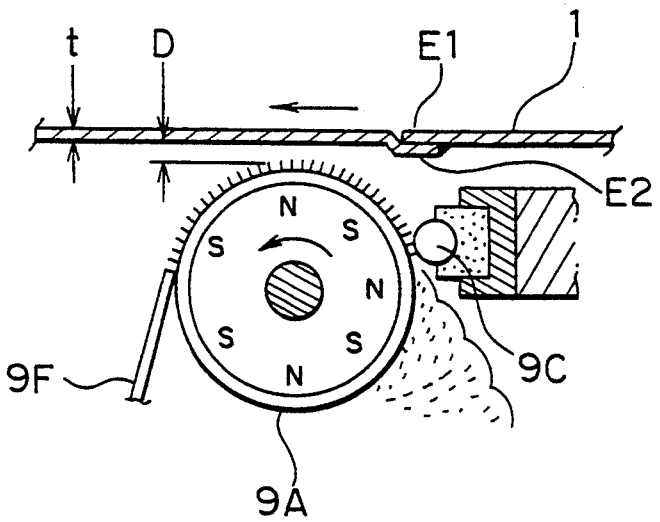
FIG. 5 is a schematic view of the essential section of the developing unit of the image forming device shown in FIG. 1.
Figure 6A:
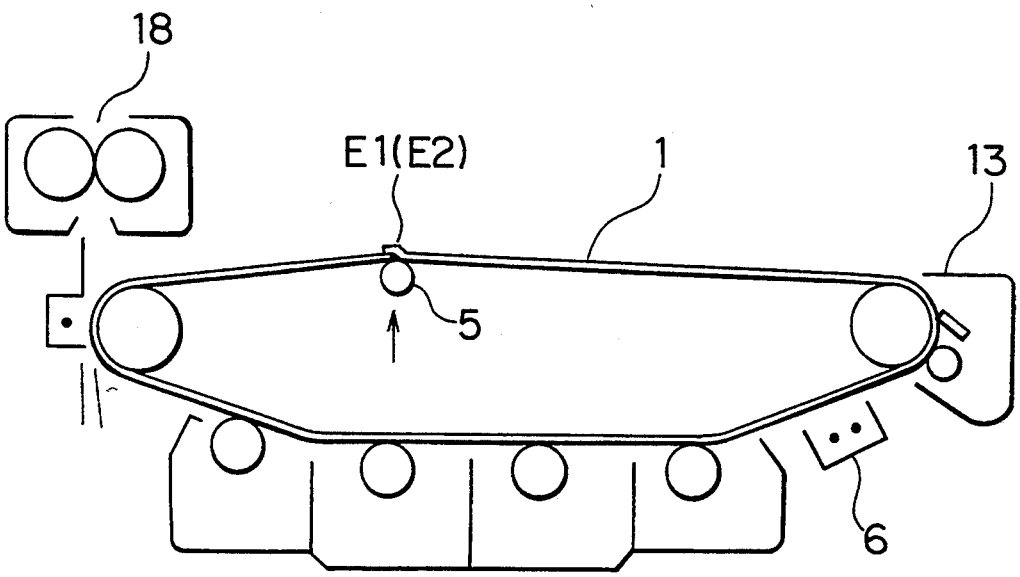
FIGS. 6-A, 6-B, 6-C, and 6-D are illustrations showing the stop position of a belt type image forming unit.
Figure 6B:
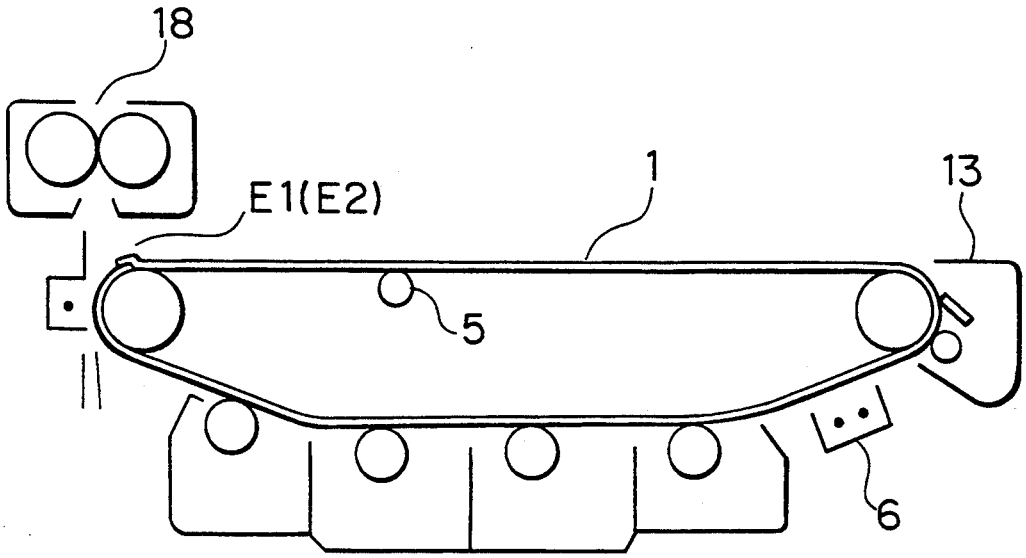
Figure 6C:
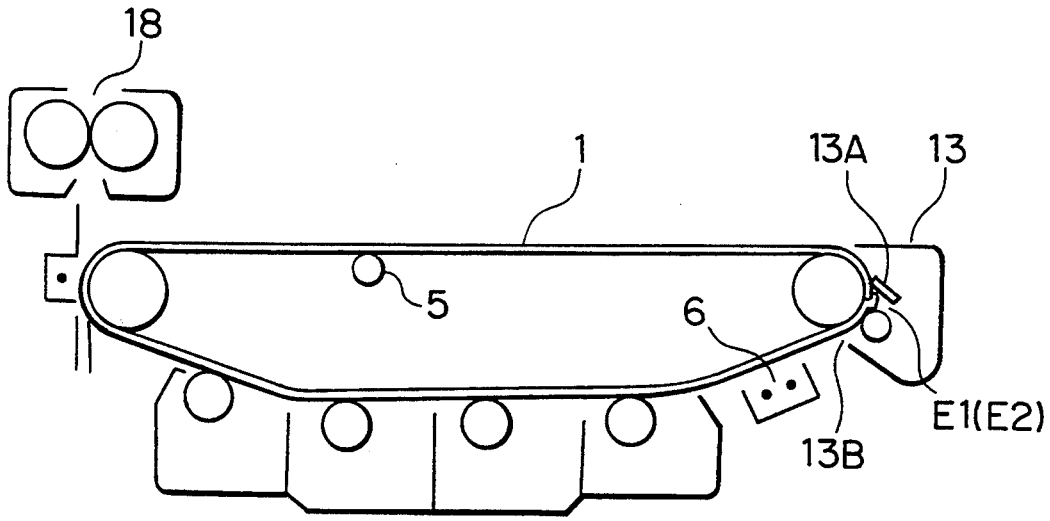
Figure 6D:
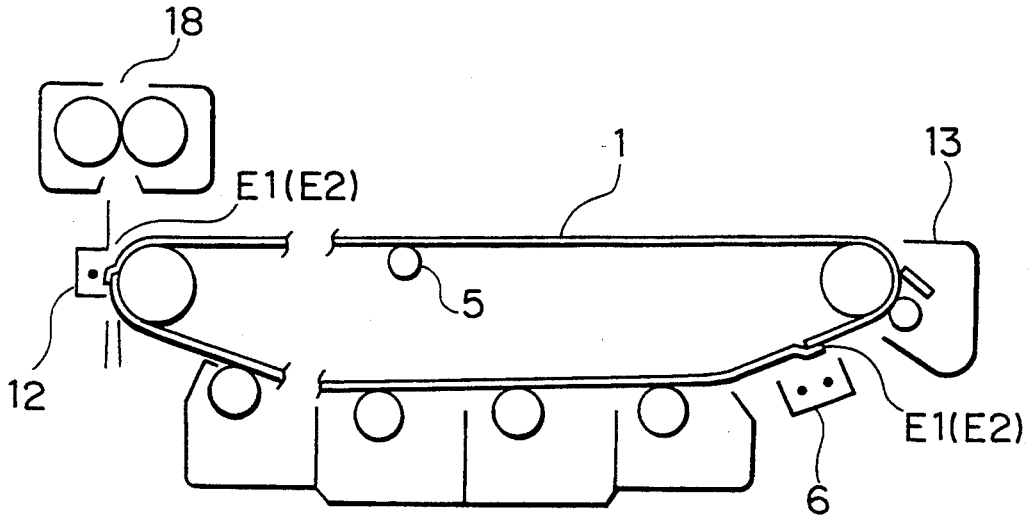

The position of the developing sleeve 9A is set by the contact of the stopper rollers 9B with the guide member 4 so that as shown in FIG. 5, a developer layer on the peripheral surface of the developing sleeve, which is formed by the thin layer forming member 9C, is facing to the image forming plane of the photoconductor belt 1 with a gap D which is larger than the thickness (t) of the photoconductor belt 1.

By doing this, the developing sleeve 9A can convey the developer layer on the peripheral surface thereof so that the layer does not touch the difference in level on the photoconductor belt 1 which is generated by splicing. Since the thickness of the photoconductor belt is generally about 100 microns, it is desirable to set the developing gap to more than 100 microns. It is desirable to set the gap D to 2 times of the thickness t or more, if possible. By doing this, toners and carriers are surely prevented from adhering to the difference in level of the spliced part of the photoconductor belt 1.

For development with a large developing gap, it is desirable to improve the developing performance by adding an AC component to the DC component of the developing bias voltage. When the spliced part passes through the developing region, toners and carriers can be effectively prevented from adhering by stopping the rotation of the developing sleeve and switching the developing bias voltage applied to the developing sleeve 9A to the DC component or floating it so as to lower the developing capability. The edge of the end E2 of the belt is chamfered obliquely, and the conductive layer exposed on the chamfered part is sealed by a highly resistant sealing material.

By doing this, a fixed developing gap, which is suited to non-contact development, is formed between the developing sleeve 9A and the peripheral surface of the photoconductor belt 1, and the developing unit 9 always can perform appropriate development. The same may be said with the developing units 8, 10, and 11; that is, the stopper rollers, which are built in each developing unit, are pressed against the guide member 4 by the well-known forcing means facility to ensure stable development.

The present invention provides a developing unit which can keep an appropriate developing gap against the photosensitive surface so that toners and carriers do not adhere onto the spliced part of a belt type image forming unit. Therefore, the present invention provides a color image forming device which can obtain images of high quality by using a belt type image forming unit which can be produced by a simple manufacturing means.

Next, control of the stop position of the photoconductor belt will be described hereunder.

In the configuration shown in FIG. 1, the photoconductor belt 1 stops the conveying operation when the spliced part of the belt or the spliced part approaches one of the specified locations in FIGS. 6-A to 6-D.

FIG. 6-A shows an example that the spliced part is positioned close to the tension roller 5. In this case, film separation or curling by the contact action of the tension roller 5 in the direction of the arrow or degradation of the photosensitive characteristics may occur in the spliced part which is a non-image region, but the image forming part of the photoconductor belt 1 stops at a safe location where the image forming part is not affected physically and characteristically.

FIG. 6-B shows an example that the spliced part is positioned close to a fixing roller 18 of the fixing unit. In this case, the degradation of the sensitivity or the charging characteristics of the photoconductor due to heat from the fixing unit is centralized in the bonded part, and the image forming part stops at a safe location where the image forming part is not affected by heat from the fixing unit.

It is desirable that the image forming part stops at the location indicated above when the fixing unit is heated after power is turned on or before the next image forming operation is performed.

FIG. 6-C shows an example that the spliced part is positioned within the cleaning unit 13. In this case, even if toners are adhered to the spliced part by the cleaning means or the characteristics of the photoconductor are changed, the image forming is not affected, and the blade 13A does not need to be released from the contact when the photoconductor belt 1 stops its conveying. When loading or unloading a process cartridge 30, the amount of toner, which may leak from the cleaning unit because the blade is kept in contact state, can be minimized.

When the cleaning unit 13 is installed close to the upper stream position of the charging unit 6 as shown in this embodiment, the image forming process can be performed within a short time after the photoconductor belt 1 starts its conveying.

FIG. 6-D shows an example that the spliced part is positioned close to the charging unit 6 which is a corona discharger or the transfer unit 12. In this case, the degradation of the photoconductor due to ozone generated by corona discharge can be limited to the spliced part which is a non-image region.

In this embodiment, the stop position is not limited to one special position. It is desirable that the image forming part stops at a plurality of satisfactory positions.

(1) In an image forming device of the present invention, the transfer unit 12 and the fixing unit 18 are installed close to each other. When the transfer part is located between the transfer unit 12 and the fixing unit, there is no need to pay attention to the photoconductor belt 1 when the jam recovery processing is performed for a transfer material in the transfer unit, and the jam recovery processing can be performed easily. When the fixing unit is installed close to the downstream position of the transfer unit 12 as shown in this embodiment, it is desirable that the spliced part is positioned close to the transfer unit 12 and the fixing unit. By doing this, the image forming part can be protected from effects of ozone and heat from the fixing unit.

(2) In an image forming device of the present invention, the cleaning unit 13 and the charging unit 6 are installed close to each other. Therefore, when the spliced part is positioned between the cleaning unit 13 and the charging unit 6, adhering of toners to the photoconductor by the cleaning means, changes of the characteristics of the photoconductor, and degradation of the photoconductor due to ozone from the charging unit can be prevented, providing satisfactory results. More than one of the stop positions mentioned above can be adopted. Needless to say, any of the stop positions can be used between the end of image forming and the start of next image forming or for another purposes.

(3) By keeping the stop position of the spliced part close to the fixing part during heating or cooling of the fixing unit 18 when starting or stopping the equipment, the effect of heat to the photoconductor can be decreased. After image forming, the spliced part is stopped between the charging unit 6 and the cleaning unit 13. By doing this, ozone degradation, toner adhesion, and degradation of the characteristics of the photoconductor can be prevented. When the next imaging process is not performed, the spliced part automatically moves to the position of the fixing unit 18 to prevent the image forming part from being affected by heat. Selection and use of a plurality of stop positions like this provide more satisfactory results.

The present invention realizes a belt type image forming unit of high quality using a simple manufacturing means, and maintains the function and performance of the belt surface corresponding to the image region in the high quality state for a long period of time. As a result, the present invention provides a compact color image forming device which can obtain color images of high quality at low cost.

Figure 7:
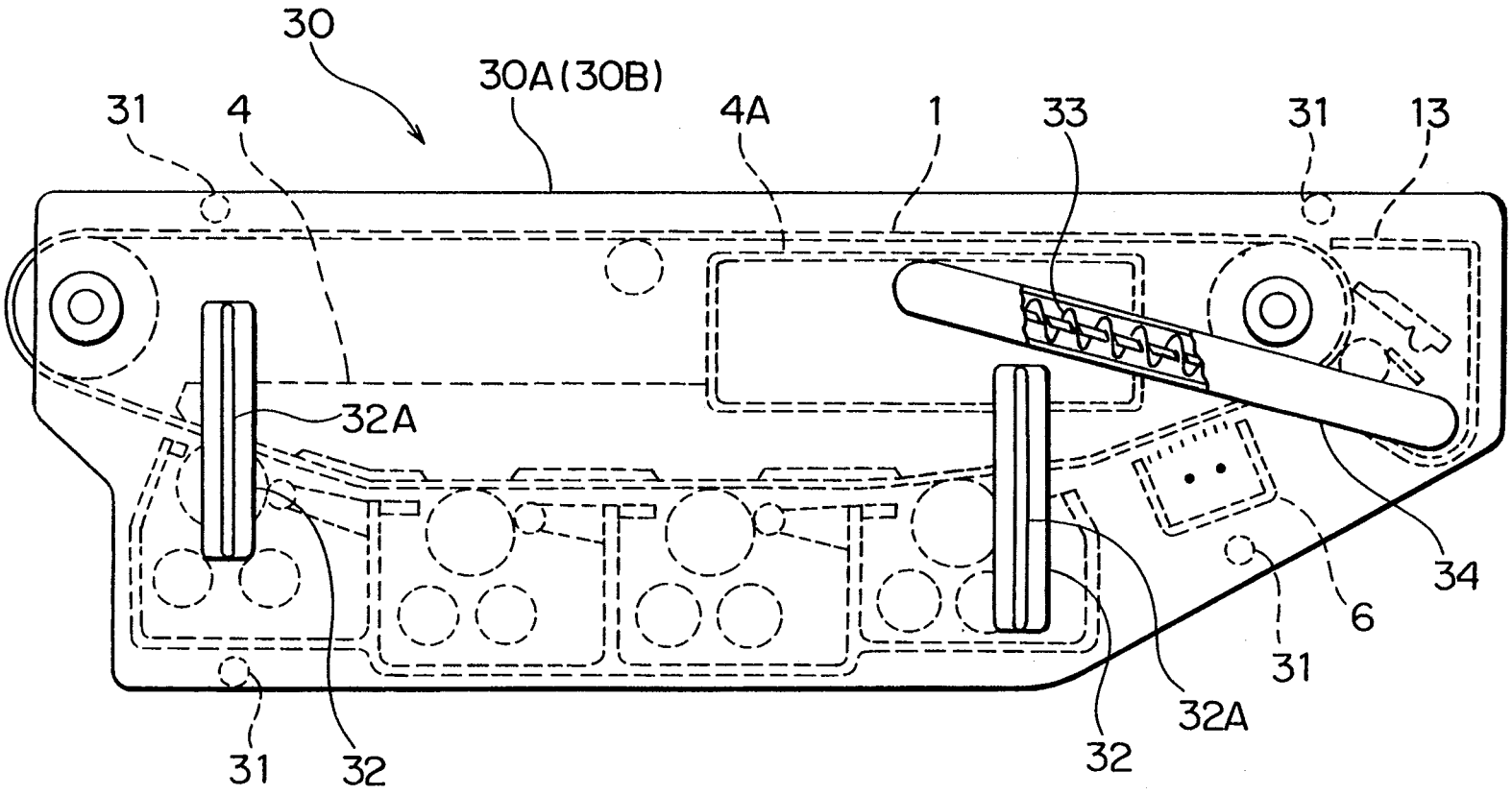
FIG. 7 is a sectional view of a unit structure of a belt type photoconductor.

It is desirable that the image forming means such as the photoconductor belt 1, guide member 4, scorotron charging unit 6, developing units, and cleaning unit 13 are incorporated in the cartridge 30 composed between panels 30A (front) and 30B (back) as shown in FIG. 7 and they are installed in or removed from the main unit of the equipment as a module.

The cartridge 30, which integrates the front and back panels 30A and 30B with four stays 31, is inserted and set from the vertically upper part of the equipment via 3 guide rails 32 which hold the above image forming means between the panels and attach them to the panels.

The guide rails 32 use convex rails 32A, though the main unit of the equipment uses guide rails (not shown in the figure) with concave shape. By connecting them, the mechanical power is transferred to the image forming means from the main unit of the equipment, and the electric power source is connected to them.

A toner conveying pipe 34 containing a flexible toner conveying screw 33 is installed on the front of the cartridge 30, and one end thereof is connected to the bottom of the cleaning unit 13 and the other end is connected to a sealing container 4A, and or which may be connected to a part of the guide member 4 to discharge the collected toner.

The toner conveying screw 33 is driven and rotated by the power of the main unit of the equipment to send and store the toners collected by the cleaning unit 13 into the sealing container 4A via the toner conveying pipe 34.

When installing or removing the cartridge 30 in or from the main unit of the equipment, the tray 20 can be opened counterclockwise at a hinge in FIG. 1 used as a fulcrum together with the fixing roller 18 and paper ejection roller 19, the cartridge 30 is pulled up vertically, and the guide rails 32 are released from connection.

In the unit configuration mentioned above, the stop position control of the photoconductor belt can be performed in the same way.

What is claimed is:

1. An apparatus for forming a toner image, wherein a photoreceptor belt is moved to a corona charging device, an image exposure device, a developing device, a transfer device, a cleaning device in that order, thereafter the photoreceptor is returned to the corona charging device to conduct a next image formation; said apparatus comprising:

said photoreceptor belt having an image surface on which toner image can be formed, both ends of said photoreceptor belt being bonded to form a loop, said loop being stretched between a plurality of rollers and rotated to carry a formed image, a position control means for controlling a stop position of the bonded ends of said photoreceptor belt, to locate said bonded ends proximate to said corona charging device.

2. The apparatus of claim 1 wherein the position control means changes the stop position of the bonded ends of said photoreceptor belt from the location proximate to said corona charging device to a location proximate to said fixing device when the next image formation is not carried out within a predetermined period of time after the previous image formation.

* * * * *